US011580891B2

(12) United States Patent
Chang et al.

(10) Patent No.: US 11,580,891 B2
(45) Date of Patent: Feb. 14, 2023

(54) COLOR SHIFT COMPENSATION METHOD, COLOR SHIFT COMPENSATION SYSTEM AND DISPLAY PANEL

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Xiaohuan Chang, Beijing (CN); Chuanyan Lan, Beijing (CN); Yong Yu, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 836 days.

(21) Appl. No.: 16/080,137

(22) PCT Filed: Feb. 9, 2018

(86) PCT No.: PCT/CN2018/075957
§ 371 (c)(1),
(2) Date: Aug. 27, 2018

(87) PCT Pub. No.: WO2019/015313
PCT Pub. Date: Jan. 24, 2019

(65) Prior Publication Data

US 2021/0193011 A1 Jun. 24, 2021

(30) Foreign Application Priority Data

Jul. 21, 2017 (CN) ..... 201710601925.5

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2320/0242* (2013.01);
(Continued)

(58) Field of Classification Search
None
See application file for complete search history.

(56) References Cited

U.S. PATENT DOCUMENTS 7,262,753 B2 * 8/2007 Tanghe ..... G09G 3/3216 345/101
2005/0083253 A1 * 4/2005 Lee ..... G09G 3/2007 345/60

(Continued)

FOREIGN PATENT DOCUMENTS

CN 1851800 A 10/2006
CN 101452668 A 6/2009

(Continued)

OTHER PUBLICATIONS

International Search Report and Written Opinion dated Apr. 28, 2018; PCT/CN2018/075957.

*Primary Examiner* — Benjamin C Lee
*Assistant Examiner* — Emily J Frank

(57) ABSTRACT

A color shift compensation method, a color shift compensation system and a display panel are provided. The color shift compensation method includes: accumulating actual display time of a display panel; determining whether or not the actual display time reaches a preset cumulative display time threshold; and in a case where the actual display time reaches the preset cumulative display time threshold, driving the display panel to display according to compensated adjustment voltages that are pre-stored, and in a case where (Continued)

the actual display time does not reach the preset cumulative display time threshold, driving the display panel to display according to current adjustment voltages that are pre-stored.

15 Claims, 3 Drawing Sheets

(52) U.S. Cl.
CPC . *G09G 2320/045* (2013.01); *G09G 2320/048* (2013.01); *G09G 2320/0673* (2013.01); *G09G 2330/12* (2013.01)

(56) References Cited

U.S. PATENT DOCUMENTS

2006/0114270 A1* 6/2006 Shih ..... G09G 3/2003 345/690
2008/0315788 A1* 12/2008 Levey ..... G09G 3/3233 315/291
2009/0147032 A1 6/2009 Kim
2011/0074750 A1* 3/2011 Leon ..... G09G 3/3233 345/207
2012/0057785 A1* 3/2012 Morovic ..... H04N 1/6047 382/167
2013/0342562 A1* 12/2013 Shintani ..... G09G 5/028 345/593
2015/0015157 A1 1/2015 Lin et al.
2016/0088278 A1* 3/2016 Velarde ..... G03B 15/05 348/371
2016/0103171 A1* 4/2016 Tsutsui ..... G01R 31/2642 257/40
2017/0076661 A1* 3/2017 Zhang ..... G09G 3/2003
2017/0213493 A1* 7/2017 Han ..... G09G 3/3208
2019/0266977 A1* 8/2019 Ward ..... G09G 5/02
2020/0045282 A1* 2/2020 Sakai ..... H04N 9/646

FOREIGN PATENT DOCUMENTS

CN 102243852 A 11/2011
CN 103680407 A 3/2014
CN 103730090 A 4/2014
CN 104732954 A 6/2015
CN 106097961 A 11/2016
CN 107204170 A 9/2017
JP 2005-084075 A 3/2005

* cited by examiner

COLOR SHIFT COMPENSATION METHOD, COLOR SHIFT COMPENSATION SYSTEM AND DISPLAY PANEL

The application claims priority to the Chinese patent application No. 201710601925.5, filed on Jul. 21, 2017, the entire disclosure of which is incorporated herein by reference as part of the present application.

TECHNICAL FIELD

Embodiments of the present disclosure relate to a color shift compensation method, a color shift compensation system, and a display panel.

BACKGROUND

Compared with conventional liquid crystal panels, active-matrix organic light emitting diode (AMOLED) panels have the characteristics such as faster response speed, higher contrast ratio, wider viewing angle, lower power consumption, and so on. However, because AMOLED panels use organic materials and are self-luminous, after long term usage, the organic materials have the problems of lifetime decay, different materials having different decay rates, and so on. Provided that the display driving signal is not changed, due to the above problems, the image display may have the problem that the longer the usage time, the greater the attenuation difference among red, green, and blue (RGB) pixels of the organic materials is, which causes the display color shift during the display operation on the client side. If AMOLED products have been used for customer installation, it is impossible to retrieve the products back to the factory and adjust the display color shift again.

SUMMARY

An embodiment of the present disclosure provides a color shift compensation method, comprising: accumulating actual display time of a display panel; determining whether or not the actual display time reaches a preset cumulative display time threshold; and in a case where the actual display time reaches the preset cumulative display time threshold, driving the display panel to display according to compensated adjustment voltages that are pre-stored, and in a case where the actual display time does not reach the preset cumulative display time threshold, driving the display panel to display according to current adjustment voltages that are pre-stored.

For example, the compensated adjustment voltages comprise a compensated gamma voltage and a reference voltage of the compensated gamma voltage, and the current adjustment voltages comprise a current gamma voltage and a reference voltage of the current gamma voltage.

For example, the preset cumulative display time threshold comprises a plurality of sub-thresholds; and the compensated adjustment voltages comprise a plurality of sets of voltages, each set of voltages comprises a compensated gamma voltage and a reference voltage, and the sub-thresholds are in one-to-one correspondence with the sets of voltages.

For example, the preset cumulative display time threshold is less than a service life of the display panel.

For example, the color shift compensation method further comprises: measuring offset data of color coordinates of the display panel varying with display time; according to the offset data of the color coordinates, determining the preset cumulative display time threshold and calculating the compensated adjustment voltages of the display panel corresponding to the preset cumulative display time threshold; and storing the preset cumulative display time threshold and the compensated adjustment voltages.

For example, the preset cumulative display time threshold is a time period during which the display panel needs to compensate for the current adjustment voltages.

An embodiment of the present disclosure further provides a color shift compensation system, comprising: a time accumulation module, configured to accumulate actual display time of a display panel; a determining module, configured to determine whether or not the actual display time reaches a preset cumulative display time threshold; and a driving module, configured to, in a case where the actual display time reaches the preset cumulative display time threshold, drive the display panel to display according to compensated adjustment voltages that are pre-stored, otherwise, drive the display panel to display according to current adjustment voltages that are pre-stored.

For example, the compensated adjustment voltages comprise a compensated gamma voltage and a reference voltage of the compensated gamma voltage, and the current adjustment voltages comprise a current gamma voltage and a reference voltage of the current gamma voltage.

For example, the color shift compensation system further comprises a storage module, configured to store the preset cumulative display time threshold and the compensated adjustment voltages.

For example, the preset cumulative display time threshold comprises a plurality of sub-thresholds; and the compensated adjustment voltages comprise a plurality of sets of voltages, each set of voltages comprises a compensated gamma voltage and a reference voltage, and the sub-thresholds are in one-to-one correspondence with the sets of voltages.

For example, the preset cumulative display time threshold is less than a service life of the display panel.

For example, the color shift compensation system further comprises: a test module, configured to measure offset data of color coordinates of the display panel varying with display time; and a determining and calculation module, configured to, according to the offset data of the color coordinates of the display panel varying with the display time, determine the preset cumulative display time threshold and calculate the compensated adjustment voltages of the display panel corresponding to the preset cumulative display time threshold.

For example, the preset cumulative display time threshold is a time period during which the display panel needs to compensate for the current adjustment voltages.

An embodiment of the present disclosure further provides a display panel, comprising the above color shift compensation system.

BRIEF DESCRIPTION OF THE DRAWINGS

In order to clearly illustrate the technical solution of the embodiments of the disclosure, the drawings of the embodiments will be briefly described in the following. It is obvious that the described drawings are only related to some embodiments of the disclosure and thus are not limitative of the disclosure.

DESCRIPTION OF THE DRAWING SIGNS

1. time accumulation module; 2. determining module; 3. driving module; 4. storage module; 5. test module; 6. determining and calculation module.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

In order to enable those skilled in the art to better understand the technical solutions of the present disclosure, the color shift compensation method, the color shift compensation system, and the display panel provided by the present disclosure are further described in detail below with reference to the accompanying drawings and the specific embodiments.

The color shift compensation method determines whether or not the actual display time of a display panel reaches a preset cumulative display time threshold, and compensates for the gamma voltage and the reference voltage thereof which drive the display panel to display according to the determination result. Therefore, it is capable of compensating for the display color shift of the display panel caused by the lifetime decay of the pixel materials as the actual display time lapses, thereby improving the display effect of the display panel, and meanwhile, relatively extending the display life of the display panel.

Figure 1:
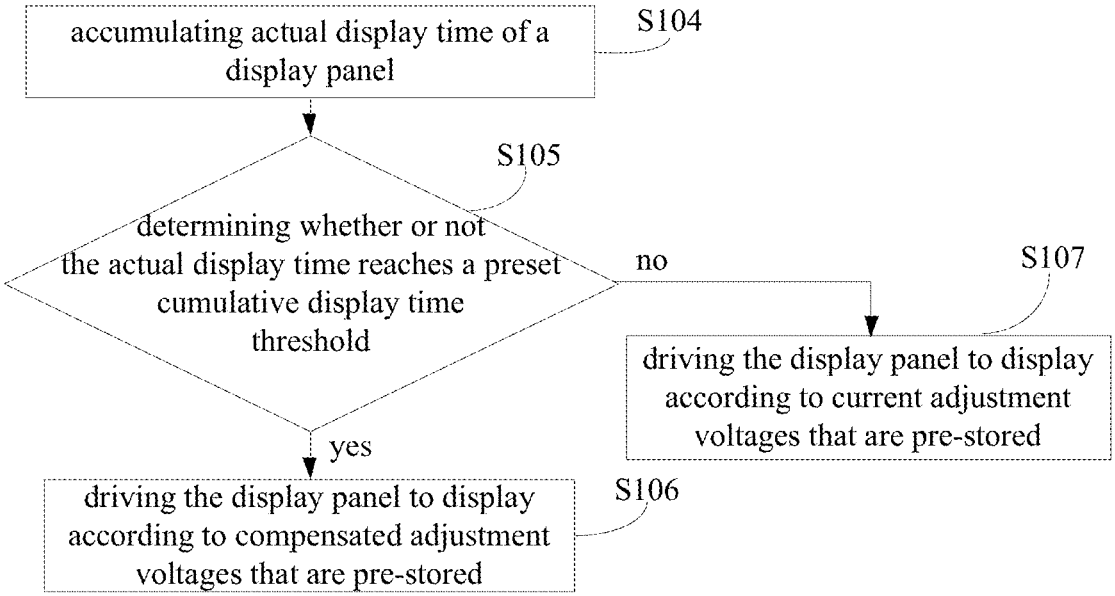
FIG. 1 is a flow chart of a color shift compensation method provided by an embodiment of the present disclosure.

An embodiment of the present disclosure provides a color shift compensation method, as illustrated in FIG. 1, which comprises:

Step S104: accumulating actual display time of a display panel.

For example, the display panel is an organic electroluminescence display panel. The organic electroluminescent display panel displays in a self-luminous way by using organic materials. The organic materials may have the problem of lifetime decay after long term usage, and different organic materials for forming pixels of different colors in the display panel are different in the lifetime decay extents as the display time lapses, thereby causing that the display panel has display color shift of different extents according to the length of the actual display time.

Step S105: determining whether or not the actual display time reaches a preset cumulative display time threshold.

In this step, the preset cumulative display time threshold is the time period during which the display panel needs to compensate for the current adjustment voltages (e.g., the current gamma voltage and the reference voltage of the current gamma voltage). That is, when the actual display time of the display panel reaches the preset cumulative display time threshold, the display panel has underwent the display color shift of a certain extent, so it is needed to compensate for the current gamma voltage and the reference voltage of the current gamma voltage of the display panel when the preset cumulative display time threshold is reached. The setting of the preset cumulative display time threshold may be specifically determined according to the user's acceptance extent of the color shift of the display panel. For example, when the display color shift of the display panel reaches 20% to 30%, the general user may feel that the color shift extent needs to be compensated, and then the corresponding actual display time at this time is set as the cumulative display time threshold. When the actual display time reaches the preset cumulative display time threshold, the display color shift is compensated, that is, the display panel is driven to display according to the compensated gamma voltage and the reference voltage of the compensated gamma voltage that are pre-stored. For example, some users with specific needs deem that it needs to perform compensation when the display color shift reaches about 10%, and the corresponding actual display time at this time may be set as the cumulative display time threshold. When the actual display time reaches the preset cumulative display time threshold, the display color shift is compensated. The extent of the display color shift and the way of determining the corresponding cumulative display time are not limited in the present disclosure.

It should be noted that one preset cumulative display time threshold may correspond to one display color shift range, or may correspond to one display color shift value.

In the embodiment of the present disclosure, the preset cumulative display time threshold is less than the service life of the display panel. That is, the color shift compensation method compensates for the color shift of the display panel within the service life of the display panel, thereby enabling the display panel to better display during its service life.

In the case where the actual display time reaches the preset cumulative display time threshold, step S106 is performed: driving the display panel to display according to compensated adjustment voltages (e.g., the compensated adjustment voltages comprise a compensated gamma voltage and a reference voltage of the compensated gamma voltage) that are pre-stored.

For example, by adjusting the gamma voltage which drives the pixels in the display panel to display, the display color shift of the display panel can be adjusted. That is, by compensating for the gamma voltage, an effective adjustment of the display color shift can be realized. The reference voltage of the gamma voltage is used as the reference voltage for the adjustment of the gamma voltage, and the gamma voltage and the reference voltage thereof simultaneously change during the entire adjustment process to achieve the adjustment of the pixel driving voltage, thereby realizing the adjustment of the display color shift of the display panel.

In the embodiment of the present disclosure, for example, the preset cumulative display time threshold comprises a plurality of sub-thresholds. The compensated adjustment voltages comprise a plurality of sets of voltages, each set of voltages comprises a compensated gamma voltage and a reference voltage, and the sub-thresholds are in one-to-one correspondence with the sets of voltages. In this way, a plurality of sub-thresholds of the preset cumulative display time threshold can be set within the service life of the display panel, thereby achieving a plurality of display color shift compensation operations for the display panel during its service life, so that not only the display panel can display well throughout its service life, but also the display life of the display panel can be extended relatively. For example, assuming that the display panel has a service life of 10,000 hours, three sub-thresholds of the preset cumulative display time threshold may be set, that is, 3,500 hours, 5,000 hours, and 7,000 hours, respectively.

For example, the compensated gamma voltage and the reference voltage thereof that are pre-stored comprise a plurality of sets, and the sub-thresholds of the preset cumulative display time threshold are in one-to-one correspondence with the sets of the compensated gamma voltage and the reference voltage thereof. That is, one sub-threshold of the preset cumulative display time threshold corresponds to one set of the compensated gamma voltage and the reference voltage thereof. Because with respect to the different lengths of the actual display time of the display panel the extents of color shift are also different, the setting of several preset cumulative display time thresholds enables the display panel to compensate for the display color shift of different extents in stages according to the different actual display time, thereby improving the display effect of the display panel in different phases, and meanwhile, relatively extending the display life of the display panel.

Of course, only one preset cumulative display time threshold may also be set. Accordingly, only one set of the compensated gamma voltage and the reference voltage thereof is set.

In the case where the actual display time does not reach the preset cumulative display time threshold, step S107 is performed: driving the display panel to display according to current adjustment voltages (e.g., the current adjustment voltages comprise a current gamma voltage and a reference voltage of the current gamma voltage) that are pre-stored.

In this step, in the case where the actual display time of the display panel does not reach the preset cumulative display time threshold, it is not necessary to compensate for the display color shift of the display panel. At this time, the display panel is driven to display according to the current gamma voltage and the reference voltage thereof. In this way, the current display effect of the display panel can be ensured.

The color shift compensation method determines whether or not the actual display time reaches the preset cumulative display time threshold, and compensates for the gamma voltage and the reference voltage thereof which drive the display panel to display according to the determination result. Therefore, it is capable of compensating for the display color shift of the display panel caused by the lifetime decay of the pixel materials as the actual display time lapses, thereby improving the display effect of the display panel, and meanwhile, relatively extending the display life of the display panel.

Figure 2:
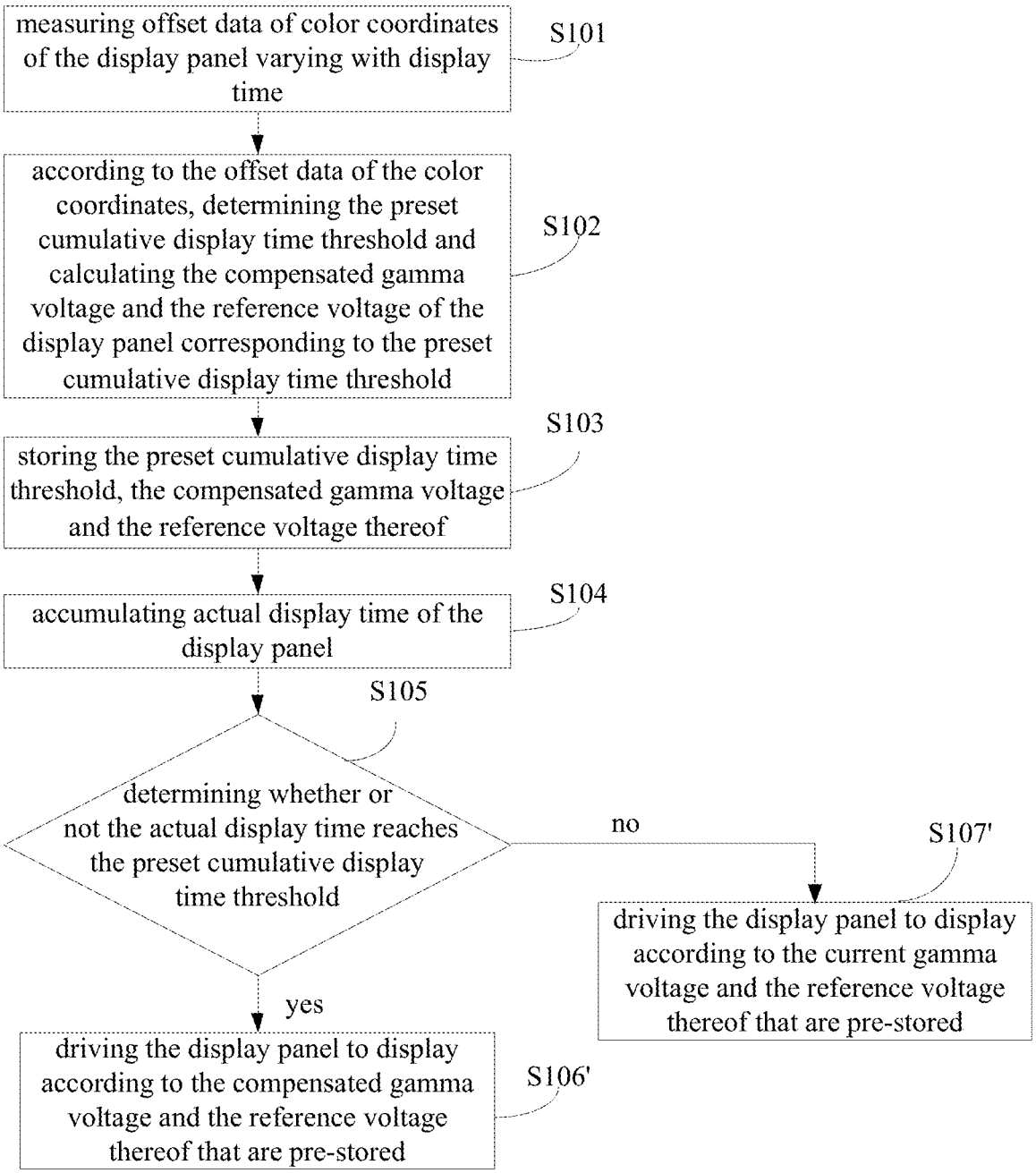
FIG. 2 is another flow chart of a color shift compensation method provided by an embodiment of the present disclosure.

In another embodiment of the present disclosure, as illustrated in FIG. 2, the color shift compensation method further comprises step S101: measuring offset data of color coordinates of the display panel varying with display time.

Figure 3:
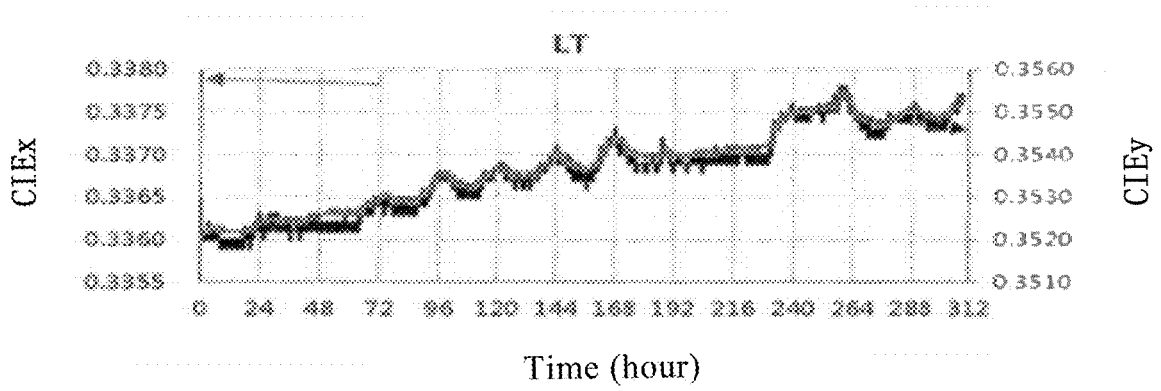
FIG. 3 is a curve of color coordinate offset data of a display panel varying with actual display time.

In this step, for example, a certain number of products are picked to perform an accelerated aging test after a certain batch of display panels are produced, and the offset data of color coordinates similar to those in FIG. 3 are obtained, which represent the offset of the color coordinates of the batch of the display panels varying with the display time.

Step S102: according to the offset data of the color coordinates, determining the preset cumulative display time threshold (or each of the sub-thresholds) and calculating the compensated gamma voltage and the reference voltage of the display panel corresponding to the preset cumulative display time threshold (or each of the sub-thresholds).

In this step, for example, the offset values of the color coordinates of the batch of the display panels are obtained according to the curve of color coordinate offset data in FIG. 3, and then the gamma voltage and the reference voltage of the batch of the display panels can be respectively adjusted at different cumulative display time periods through simulating the color coordinates in each case, so that the color coordinates of the display panels which offset as the accumulation of the display time are restored to the standard target values when the display panels leave the factory, thereby alleviating the display color shift of the batch of the display panels as the accumulation of the display time, and improving the display effect of the display panels.

Through steps S101-S102, the preset cumulative display time threshold (or each of the sub-thresholds) can be accurately determined before the color shift compensation, and the compensated gamma voltage and the reference voltage thereof are accurately calculated. Therefore, it is convenient to call these parameters in the subsequent color shift compensation process, thereby realizing timely compensation for the display color shift of the display panel.

Step S103: storing the preset cumulative display time threshold and the compensated gamma voltage and the reference voltage thereof.

In this step, the preset cumulative display time threshold, the compensated gamma voltage and the reference voltage thereof are stored in the registers of the driving circuit in the display panel, thereby facilitating the conditional determination and the driving call by the display panel during the display process.

It should be noted that, in the embodiment of the present disclosure, step S101 and step S102 may also be performed in real time. That is, the offset data of the color coordinates of the display panel varying with the display time are measured in real time; according to the offset data of the color coordinates, the gamma voltage and the reference voltage thereof which are capable of compensating the color coordinates shift and driving the display panel to display are calculated in real time; and the gamma voltage and the reference voltage thereof are provided to the driving circuit in real time, thereby realizing the real-time compensation for the color coordinates offset of the display panel.

As illustrated in FIG. 2, the color shift compensation method further comprises: step S104, accumulating the actual display time of the display panel; and step S105, determining whether or not the actual display time reaches the preset cumulative display time threshold. In the case where the actual display time reaches the preset cumulative display time threshold, step S106' is performed, that is, driving the display panel to display according to the compensated gamma voltage and the reference voltage thereof which are pre-stored. In the case where the actual display time does not reach the preset cumulative display time threshold, step S107' is performed, that is, driving the display panel to display according to the current gamma voltage and the reference voltage thereof which are pre-stored.

The color shift compensation method provided by the embodiments of the present disclosure determines whether or not the actual display time reaches the preset cumulative display time threshold, and compensates for the gamma voltage and the reference voltage thereof which drive the display panel to display according to the determination result. It is capable of compensating for the display color shift of the display panel caused by the lifetime decay of the pixel materials as the actual display time lapses, thereby improving the display effect of the display panel, and meanwhile, relatively extending the display life of the display panel.

Figure 4:
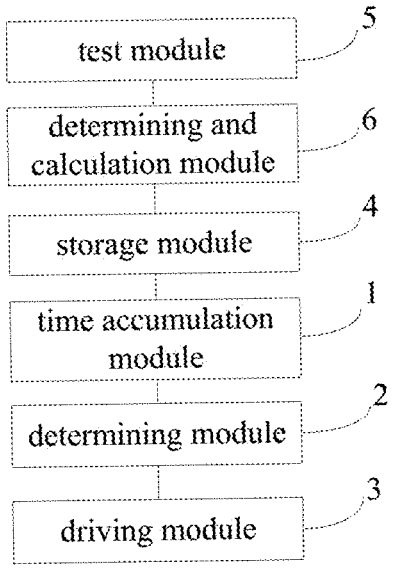
FIG. 4 is a schematic block diagram of a color shift compensation system provided by an embodiment of the present disclosure.

An embodiment of the present disclosure further provides a color shift compensation system, as illustrated in FIG. 4, which comprises: a time accumulation module 1, configured to accumulate actual display time of a display panel; a determining module 2, configured to determine whether or not the actual display time reaches a preset cumulative display time threshold; and a driving module 3, configured to, in a case where the actual display time reaches the preset cumulative display time threshold, drive the display panel to display according to compensated adjustment voltages (e.g., the compensated adjustment voltages comprise a compensated gamma voltage and a reference voltage of the compensated gamma voltage) that are pre-stored, otherwise, drive the display panel to display according to current adjustment voltages (e.g., the current adjustment voltages comprise a current gamma voltage and a reference voltage of the current gamma voltage) that are pre-stored.

For example, the time accumulation module 1 adopts a timer. The preset cumulative display time threshold, the compensated gamma voltage and the reference voltage thereof are all pre-stored in the register(s) of the driving circuit. The preset cumulative display time threshold is the time period during which the display panel needs to compensate for the current gamma voltage and the reference voltage thereof.

Through provision of the determining module 2 and the driving module 3, according to the determination result, the color shift compensation system can compensate for the gamma voltage and the reference voltage thereof which drive the display panel to display, thereby compensating for the display color shift of the display panel caused by the lifetime decay of the pixel materials as the actual display time lapses, improving the display effect of the display panel, and meanwhile, relatively extending the display life of the display panel.

In an embodiment of the present disclosure, the color shift compensation system further comprises a storage module 4, which is configured to store the preset cumulative display time threshold and the compensated adjustment voltages.

For example, the preset cumulative display time threshold comprises a plurality of sub-thresholds, and the compensated adjustment voltages comprise a plurality of sets of voltages. The storage module 4 is configured to store the sub-thresholds of the preset cumulative display time threshold and the sets of voltages (each set of voltages comprises a compensated gamma voltage and a reference voltage thereof). One sub-threshold of the preset cumulative display time threshold corresponds to one set of voltages (that is, one compensated gamma voltage and one reference voltage thereof). The storage of the sub-thresholds of the preset cumulative display time threshold makes it possible to achieve a plurality of display color shift compensations for the display panel during its service life, so that not only the display panel can display well throughout its entire service life, but also the display life of the display panel can be extended relatively. The storage of the sets of the compensated gamma voltages and the reference voltages thereof enables the display panel to compensate for the display color shift of different extents in stages according to different actual display time periods, thereby improving the display effect of the display panel in different phases, and meanwhile, relatively extending the display life of the display panel.

In the embodiment of the present disclosure, the preset cumulative display time threshold is less than the service life of the display panel. That is, the color shift compensation system compensates for the color shift of the display panel during the service life of the display panel, thereby enabling the display panel to display better during the service life of the display panel.

In an embodiment of the present disclosure, the color shift compensation system further comprises a test module 5, which is configured to measure offset data of color coordinates of the display panel varying with display time. The color shift compensation system further comprises a determining and calculation module 6, which is configured to, according to the offset data of the color coordinates, determine the preset cumulative display time threshold (or each of the sub-thresholds) and calculate the compensated gamma voltage and the reference voltage of the display panel corresponding to the preset cumulative display time threshold (or each of the sub-thresholds).

By provision of the test module 5 and the determining and calculation module 6, the preset cumulative display time threshold can be accurately determined before the color shift compensation, and the compensated gamma voltage and the reference voltage thereof are accurately calculated. Therefore, it is convenient to call these parameters in the subsequent color shift compensation process, thereby realizing timely compensation for the display color shift of the display panel.

By provision of the determining module 2 and the driving module 3, according to the determination result, the color shift compensation system provided by the embodiments of the present disclosure is capable of compensating for the gamma voltage and the reference voltage thereof which drive the display panel to display, thereby compensating for the display color shift of the display panel caused by the lifetime decay of the pixel materials as the actual display time lapses, improving the display effect of the display panel, and meanwhile, relatively extending the display life of the display panel.

The color shift compensation system provided by the embodiments of the present disclosure may further comprise one or more processors and one or more memories. The processor can process the data signals and may be implemented in various computation structures, such as the complex instruction set computer (CISC) structure, the reduced instruction set computer (RISC) structure, or a structure that implements a combination of various instruction sets. The memory can store the instructions or data executed by the processor. These instructions or data may comprise codes for implementing some or all of the functions of one or more of the devices described in the embodiments of the present application. For example, the memory comprises the dynamic random access memory (DRAM), the static random access memory (SRAM), the flash memory, the optical memory, or other memory well known by those skilled in the art.

In some embodiments, each of the modules (e.g., the test module, the determining and calculation module, the storage module, the time accumulation module, the determining module, and the driving module) comprises codes and programs stored in a memory; and the processor can execute the codes and the programs to implement some or all of the functions described above.

In some embodiments, each of the modules (e.g., the test module, the determining and calculation module, the storage module, the time accumulation module, the determining module, and the driving module) may be a dedicated hardware device for implementing some or all of the functions described above. For example, each of the modules may be one circuit board or a combination of several circuit boards for implementing the functions described above. Alternatively, each of the modules may be integrated into one integrated circuit chip.

An embodiment of the present disclosure also provides a display panel, which comprises the color shift compensation system described above.

By adopting the color shift compensation system described above, the display color shift of the display panel caused by the lifetime decay of the pixel materials as the actual display time lapses is alleviated, thereby improving the display effect of the display panel, and meanwhile, relatively extending the display life of the display panel.

The display panel provided by the embodiments of the present disclosure may be any product or component having a display function, such as an organic light emitting diode (OLED) panel, an OLED television, a liquid crystal panel, a liquid crystal television, a displayer, a mobile phone, a navigator, or the like.

It should be understood that the above embodiments are merely exemplary embodiments to explain the principles of the present disclosure, but the present disclosure is not limited thereto. Various modifications and improvements can be made by those skilled in the art without departing from the spirit and scope of the present disclosure, and such modifications and improvements are also considered to be within the scope of the present disclosure. The scopes of the present disclosure are defined by the accompanying claims.

The invention claimed is:

1. A color shift compensation method, comprising:

accumulating actual display time of a display panel;

determining whether or not the actual display time reaches a preset cumulative display time threshold; and in a case where the actual display time reaches the preset cumulative display time threshold, driving the display panel to display according to compensated adjustment voltages that are pre-stored, and in a case where the actual display time does not reach the preset cumulative display time threshold, driving the display panel to display according to current adjustment voltages that are pre-stored, wherein the preset cumulative display time threshold is determined based on a corresponding display color shift range or one display color shift value, and the preset cumulative display time threshold is adjustable and determined according to user's acceptance extent of color shift of the display panel.

2. The color shift compensation method according to claim 1, wherein the compensated adjustment voltages comprise a compensated gamma voltage and a reference voltage of the compensated gamma voltage, and the current adjustment voltages comprise a current gamma voltage and a reference voltage of the current gamma voltage.

3. The color shift compensation method according to claim 1, wherein the preset cumulative display time threshold comprises a plurality of sub-thresholds; and the compensated adjustment voltages comprise a plurality of sets of voltages, each set of voltages comprises a compensated gamma voltage and a reference voltage, and the sub-thresholds are in one-to-one correspondence with the sets of voltages.

4. The color shift compensation method according to claim 1, wherein the preset cumulative display time threshold is less than a service life of the display panel.

5. The color shift compensation method according to claim 1, further comprising:

measuring offset data of color coordinates of the display panel varying with display time;

according to the offset data of the color coordinates, determining the preset cumulative display time threshold and calculating the compensated adjustment voltages of the display panel corresponding to the preset cumulative display time threshold; and storing the preset cumulative display time threshold and the compensated adjustment voltages.

6. The color shift compensation method according to claim 5, wherein the preset cumulative display time threshold is a time period during which the display panel needs to compensate for the current adjustment voltages.

7. A color shift compensation system, comprising:

a time accumulation module, configured to accumulate actual display time of a display panel;

a determining module, configured to determine whether or not the actual display time reaches a preset cumulative display time threshold; and a driving module, configured to, in a case where the actual display time reaches the preset cumulative display time threshold, drive the display panel to display according to compensated adjustment voltages that are pre-stored, otherwise, drive the display panel to display according to current adjustment voltages that are pre-stored, wherein the preset cumulative display time threshold is determined based on a corresponding display color shift range or one display color shift value, and the preset cumulative display time threshold is adjustable and determined according to user's acceptance extent of color shift of the display panel.

8. The color shift compensation system according to claim 7, wherein the compensated adjustment voltages comprise a compensated gamma voltage and a reference voltage of the compensated gamma voltage, and the current adjustment voltages comprise a current gamma voltage and a reference voltage of the current gamma voltage.

9. The color shift compensation system according to claim 7, further comprising a storage module, configured to store the preset cumulative display time threshold and the compensated adjustment voltages.

10. The color shift compensation system according to claim 7, wherein the preset cumulative display time threshold comprises a plurality of sub-thresholds; and the compensated adjustment voltages comprise a plurality of sets of voltages, each set of voltages comprises a compensated gamma voltage and a reference voltage, and the sub-thresholds are in one-to-one correspondence with the sets of voltages.

11. The color shift compensation system according to claim 7, wherein the preset cumulative display time threshold is less than a service life of the display panel.

12. The color shift compensation system according to claim 7, further comprising:

a test module, configured to measure offset data of color coordinates of the display panel varying with display time; and a determining and calculation module, configured to, according to the offset data of the color coordinates of the display panel varying with the display time, determine the preset cumulative display time threshold and calculate the compensated adjustment voltages of the display panel corresponding to the preset cumulative display time threshold.

13. The color shift compensation system according to claim 12, wherein the preset cumulative display time threshold is a time period during which the display panel needs to compensate for the current adjustment voltages.

14. A display panel, comprising the color shift compensation system according to claim 7.

15. A color shift compensation device, comprising:

a processor, a nonvolatile memory, storing computer program code which is capable of being executed by the processor to conduct following steps:

accumulating actual display time of a display panel;

determining whether or not the actual display time reaches a preset cumulative display time threshold; and in a case where the actual display time reaches the preset cumulative display time threshold, driving the display panel to display according to compensated adjustment voltages that are pre-stored, and in a case where the actual display time does not reach the preset cumulative display time threshold, driving the display panel to display according to current adjustment voltages that are pre-stored, wherein the preset cumulative display time threshold is determined based on a corresponding display color shift range or one display color shift value, and the preset cumulative display time threshold is adjustable and determined according to user's acceptance extent of color shift of the display panel.

* * * * *